US007304230B2

(12) United States Patent
Parsons et al.

(10) Patent No.: US 7,304,230 B2
(45) Date of Patent: Dec. 4, 2007

(54) MULTIPLE CHANNEL METRONOME

(75) Inventors: Christopher V. Parsons, San Antonio, TX (US); David M. Tumey, Crestview, FL (US)

(73) Assignee: Solutions for Thought, LLC, San Antonio, TX (US)

( * ) Notice: Subject to any disclaimer, the term of this patent is extended or adjusted under 35 U.S.C. 154(b) by 77 days.

(21) Appl. No.: 11/138,752

(22) Filed: May 26, 2005

(65) Prior Publication Data

US 2006/0070512 A1 Apr. 6, 2006

Related U.S. Application Data

(63) Continuation-in-part of application No. PCT/US03/23633, filed on Jul. 29, 2003, which is a continuation of application No. 10/306,263, filed on Nov. 27, 2002, now abandoned.

(51) Int. Cl.
*G10H 1/40* (2006.01)
*G10H 7/00* (2006.01)

(52) U.S. Cl. ..... 84/611; 84/600; 84/612; 84/651; 84/652; 84/723

(58) Field of Classification Search ..... None
See application file for complete search history.

(56) References Cited

U.S. PATENT DOCUMENTS

| | | | | |
|---|---|---|---|---|
| 1,425,523 | A | 8/1922 | Hammond, Jr. | |
| 3,467,959 | A | 9/1969 | Zazofsky | |
| 3,595,122 | A | 7/1971 | Brediceanu | |
| 3,919,915 | A * | 11/1975 | Isbell | 84/484 |
| 3,991,648 | A | 11/1976 | Karpowicz | |
| D249,936 | S | 10/1978 | Ishida | |
| 4,193,257 | A * | 3/1980 | Watkins | 84/484 |
| 4,462,297 | A | 7/1984 | Dill et al. | |
| 4,559,929 | A | 12/1985 | Hseu | |
| 4,570,616 | A | 2/1986 | Kunz et al. | |
| 4,602,551 | A * | 7/1986 | Firmani et al. | 84/484 |
| 4,853,854 | A * | 8/1989 | Behar et al. | 700/295 |
| 5,054,361 | A | 10/1991 | Usa | |
| 5,515,764 | A | 5/1996 | Rosen | |

(Continued)

FOREIGN PATENT DOCUMENTS

EP 1 523 163 4/2005

(Continued)

OTHER PUBLICATIONS

A DVD video (d. Jul. 29, 2003) of Parsons' classroom test of prototype w/ mixed student population, incl. partially deaf and borderline autistic children.

*Primary Examiner*—Marlon Fletcher
(74) *Attorney, Agent, or Firm*—Gunn & Lee, P.C.

(57) ABSTRACT

A multiple channel metronome for use by a plurality of musicians generally includes a signal generator for producing electrical signals according to desired timing schemes and a plurality of transducers in communication with the signal generator. Each transducer, which may take the form of a piezoelectric device, a buzzer, electrodes or any substantial equivalent, is adapted to impart a sensation to one of the musicians in response to one of the generated electrical signals. The communication may be established with hardwired connections, infrared links or a radio frequency transmission system. The signal generator is under the centralized control of a conductor, bandleader, lead musician or music instructor.

28 Claims, 6 Drawing Sheets

U.S. PATENT DOCUMENTS

| | | | | |
|---|---|---|---|---|
| 5,581,484 | A | 12/1996 | Prince | |
| 5,959,230 | A | 9/1999 | Fulford | |
| 6,040,517 | A | 3/2000 | Sakamoto | |
| 6,090,037 | A * | 7/2000 | Gavish | 600/27 |
| 6,102,875 | A | 8/2000 | Jones | |
| 6,217,533 | B1 | 4/2001 | McCambridge | |
| 6,432,072 | B1 | 8/2002 | Harris et al. | |
| 6,461,377 | B1 | 10/2002 | An | |
| 6,653,545 | B2 | 11/2003 | Redmann et al. | |
| 6,714,123 | B1 | 3/2004 | Hideki et al. | |
| D488,078 | S | 4/2004 | Nakakjima et al. | |
| 6,737,572 | B1 | 5/2004 | Jameson et al. | |
| 6,774,297 | B1 | 8/2004 | Lee | |
| 6,850,150 | B1 | 2/2005 | Ronkainen | |
| 6,850,782 | B2 | 2/2005 | Bright et al. | |
| 2002/0149561 | A1 | 10/2002 | Fukumoto et al. | |
| 2002/0165921 | A1 | 11/2002 | Sapieyevski | |
| 2003/0003976 | A1 | 1/2003 | Mura | |
| 2003/0024375 | A1 | 2/2003 | Sitrick | |
| 2003/0236101 | A1 | 12/2003 | Kemppinen | |
| 2004/0067780 | A1 | 4/2004 | Eiden | |
| 2004/0079220 | A1 | 4/2004 | Yagi | |
| 2004/0099132 | A1 | 5/2004 | Parsons | |
| 2004/0100366 | A1 | 5/2004 | Parsons | |
| 2004/0168565 | A1 | 9/2004 | Nagao et al. | |
| 2004/0255756 | A1 | 12/2004 | Nagakura | |
| 2005/0064912 | A1 | 3/2005 | Yang et al. | |
| 2005/0275508 | A1 | 12/2005 | Orr et al. | |
| 2006/0070514 | A1 * | 4/2006 | Parsons et al. | 84/730 |

FOREIGN PATENT DOCUMENTS

| | | |
|---|---|---|
| EP | 1 600 907 | 11/2005 |
| JP | 58113779 | 7/1983 |
| JP | 10 248192 | 9/1998 |
| JP | 2001154672 | 6/2001 |
| JP | 2001 259134 | 9/2001 |
| JP | 2002261637 | 9/2002 |
| JP | 2003 145049 | 5/2003 |
| JP | 2004 113944 | 4/2004 |
| JP | 2004205483 | 7/2004 |
| JP | 2004317404 | 11/2004 |
| WO | WO 03/052528 | 6/2003 |
| WO | WO 03/062930 | 7/2003 |
| WO | WO 03/105313 | 12/2003 |

* cited by examiner

MULTIPLE CHANNEL METRONOME

RELATED APPLICATIONS

This application claims priority, under 35 U.S.C. § 120 as a continuation-in-part, to P.C.T. international application Ser. No. PCT/US03/23633 filed Jul. 29, 2003 and designating the United States, which is a continuation of U.S. patent application Ser. No. 10/306,263 filed Nov. 27, 2002 now abandoned. By this reference the full disclosures, including the drawings, of P.C.T international application Ser. No. PCT/US03/23633 and U.S. patent application Ser. No. 10/306,263 are incorporated herein as though now set forth in their respective entireties. Additionally, the full disclosures, including the drawings, of Applicant's co-pending U.S. patent application entitled VIBRATING TRANSDUCER WITH PROVISION FOR EASILY DIFFERENTIATED MULTIPLE TACTILE STIMULATIONS filed May 26, 2005 in the name of David M. Tumey, Applicant's co-pending U.S. patent application entitled TACTILE METRONOME filed May 26, 2005 in the names of Christopher V. Parsons and David M. Tumey and Applicant's co-pending U.S. patent application entitled METRONOME WITH WIRELESS TRANSDUCER filed May 26, 2005 in the names of Christopher V. Parsons and David M. Tumey are incorporated herein as though each were now set forth in their respective entireties.

FIELD OF THE INVENTION

The present invention relates to music technology. More particularly, the invention relates to a metronome with provision for communication with multiple musicians through separate communication channels such that each musician may be provided with an individualized, yet synchronized, beat pattern and or tempo through his or her own transducer, which may be collocated with, or located remotely from, a signal generator under the control of a conductor, bandleader, lead musician, music instructor or the like.

BACKGROUND OF THE INVENTION

The metronome is well established as a fundamental tool of musical education. Having been developed before the advent of the electrical apparatus, the traditional metronome comprises a mechanical assembly adapted to generate a clicking sound at a desired beat frequency. With the advent of modem electronics a very precise audio output may now be produced or, as is particularly useful for the musical education of deaf persons, the output signal from the metronome may be communicated with a visual indicator such as a flashing light.

While the improvements made possible through technology are meritorious, Applicant has discovered that the improvements generally serve only to better implement a fundamentally flawed method. In particular, Applicant has noted that the audio nature of the metronome, which is apparently a holdover from the days of primitive technology, is distracting to the musician and, in at least some musical environments, ineffective due to the inability of the musician to clearly hear the audio signal. Additionally, the audio signal is wholly inappropriate for use by the hearing impaired. While this latter issue has been at least addressed through metronomes with visual outputs, it is noted that the use of the visual indicator mandates that the musician completely memorizes his or her music. Additionally, traditional metronomes are self-contained. As a result, it is cumbersome for a conductor, bandleader or lead musician to control the output of a metronome being used by another. Further, such traditional metronomes can be used only by multiple musicians in close proximity one to another. Still further, the use of multiple traditional metronomes by multiple musicians is made virtually impossible by the inability to synchronize the timing of the outputs of the multiple metronomes. Finally, traditional metronomes make no provision for synchronized use by musicians playing different parts of an orchestral musical selection, in which the different musicians may play at differing tempos or according to differing rhythmic patterns.

It is therefore an overriding object of the present invention to improve over the prior art by providing a multiple channel metronome that is free of the foregoing flaws. In particular, it is an object of the present invention to provide a metronome having a plurality of hardwired or wireless interconnections between a central signal generator and a plurality of transducers. Additionally, it is an object of the present invention to provide such a metronome that also may be programmed to provide enhanced capabilities such as, for example, complex output rhythms and/or tactile stimulation designed for the development of articulation. Finally, it is an object of the present invention to provide such a metronome that is also economical to produce and easy to use.

SUMMARY OF THE INVENTION

In accordance with the foregoing objects, the present invention - a multiple channel metronome for use under the control of a leader by a plurality of musicians, generally comprises a base unit, for generating and, in at least one embodiment of the present invention, transmitting timing signals, and a plurality of transducers, for producing, according to the signals generated by the base unit, stimulations perceivable by a plurality of musicians, who may be collocated with the base unit or located at one or more places remote from the base unit. In embodiments contemplating location of one or more musicians at a location remote from the base unit, the metronome further comprises one or more transducer units for receiving signals transmitted from the base unit, as will be better understood further herein. An unlimited number of transducer units may be implemented so long as each receiver of the transducer units is tuned to receive the signals output from one of the transmitters of the base unit.

The base unit of the multiple channel metronome of the present invention comprises a signal generator in electrical communication with a controller and, preferably, one or more transmitters. The controller is preferably programmed to facilitate user selection of the characteristics of the signal generated by the signal generator and, in embodiments comprising at least one transmitter, for controlling the transmission through the transmitter of generated signals. A display, which may comprise a liquid crystal display, light emitting diode display or any other substantially equivalent structure, and a user input system, which may comprise a touch screen control and/or a computer interface such as a USB port, wireless interface or the like, or buttons or dials, are also preferably provided in connection with the controller for use in inputting and monitoring user selections.

Additionally, the controller is programmed to control the signal generator for the generation of individualized signals for output to each channel from the base unit. In the preferred embodiment of the present invention, the controller is thus adapted to produce multiple outputs having differing tempos or complex rhythmic patterns, but that are synchronized in time such that, for example, one musician may receive stimuli indicating quarter notes, another may receive stimuli indicating eighth notes, another may receive stimuli indicating a rhythmic pattern and so forth, yet all receive stimuli timed to indicate common measure beginnings.

For embodiments comprising wireless transmission of the generated signals, the transducer unit (or units) of the present invention generally comprises a receiver, for receiving the signal transmitted from the transmitter of the base unit, and a transducer, for producing according to the received signal a stimulation perceivable by the musician using the transducer unit. Additionally, each transducer unit may comprise a driver circuit as may be necessary to convert the output from the receiver to a signal appropriate for use by the transducer associated with the transducer unit. Likewise, a driver circuit is also provided in association with the base unit for each hardwired channel from the base unit as appropriate for use by the transducer associated with each particular hardwired channel.

Although any wireless technology, such as, for example, an infrared transmission system, may be utilized for implementation of the present invention, it is preferable to utilize a radio frequency transmission system as a radio frequency transmission system generally has greater range capability than does an infrared system and is also generally more impervious to varying lighting conditions and the presence of obstructions between the base unit and a remotely located transducer unit. Additionally, an appropriate radio frequency transmission system may generally be as readily and economically implemented as any other wireless technology.

In at least one embodiment, the signal generator is adapted to produce complex rhythms and may be programmable such that the musician may define the complex rhythm. In this embodiment, the signal generator preferably further comprises a micro-controller.

In at least one embodiment of the present invention, a vibrating transducer for producing multiple, readily differentiable tactile stimulations is provided. In the preferred embodiment of the present invention, the vibrating transducer generally comprises a rigid housing; an electric motor enclosed within the rigid housing and having attached thereto an eccentric weight; and wherein the electric motor is supported within the rigid housing by a flexible motor mount. The rigid housing comprises a generally cylindrically shaped tube.

The flexible motor mount may be formed of a cushion, which may be made from foam material or the like. In at least one embodiment of the present invention, the cushion is wrapped substantially about the electric motor, centering the electric motor within the cylindrically shaped tube forming the rigid housing. In order to facilitate manufacture of the vibrating transducer of the present invention, the cushion may be wrapped by a securing sheet such as, for example, a thin paper wrapping, a length of adhesive tape or the like.

In a further embodiment of the vibrating transducer of the present invention, a driver circuit may be provided for facilitating operation of the electric motor. The driver circuit may include a current amplifier.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 1:
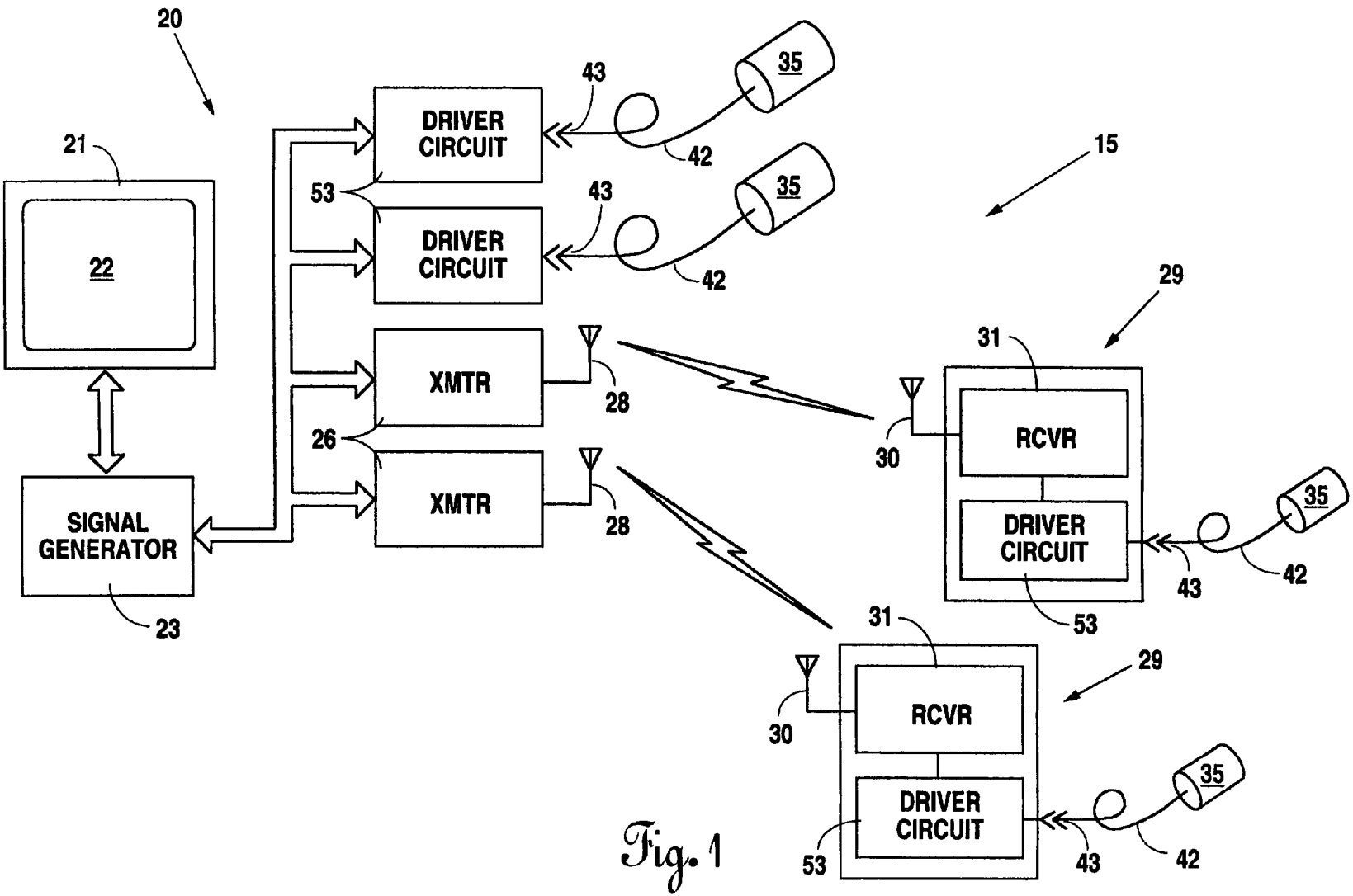
FIG. 1 shows, in a functional block diagram, the preferred embodiment of the multiple channel metronome of the present invention.

Referring now to FIG. 1, in particular, the multiple channel metronome 15 of the present invention is shown to generally comprise a base unit 20, for generating and, in at least one embodiment of the present invention, transmitting timing signals, and a plurality of transducers 35, for producing, according to the signals generated by the base unit 20, stimulations perceivable by a plurality of musicians, who may be collocated with the base unit or located at one or more places remote from the base unit 20. In embodiments contemplating location of one or more musicians at locations remote from the base unit 20, the metronome further comprises one or more transducer units 29 for receiving signals transmitted from the base unit, as will be better understood further herein. As will be appreciated by those of ordinary skill in the art, and as will also be clearer further herein, an unlimited number of transducer units 29 may be implemented so long as each receiver 31 of the transducer units 29 is tuned to receive the signals output from one of the transmitters 26 of the base unit 20.

As shown in FIG. 1, the base unit 20 of the metronome of the present invention comprises a signal generator 23 in electrical communication with a controller 21 and, preferably, one or more transmitters 26. The controller 21 is preferably programmed to facilitate user selection of the characteristics of the signal generated by the signal generator 23 and, in embodiments comprising at least one transmitter 26, for controlling the transmission through the transmitter 26 of generated signals. A display, which may comprise a liquid crystal display, light emitting diode display or any other substantially equivalent structure, and a user input system, which may comprise a touch screen control 22, as also shown in FIG. 1, and/or a computer interface such as a USB port, wireless interface or the like, or buttons or dials, are also preferably provided in connection with the controller 21 for use in inputting and monitoring user selections.

Additionally, the controller 21 is programmed to control the signal generator 23 for the generation of individualized signals for output to each channel from the base unit 20. In the preferred embodiment of the present invention, the controller 21 is thus adapted to produce multiple outputs having differing tempos or complex rhythmic patterns, but that are synchronized in time such that, for example, one musician may receive stimuli indicating quarter notes, another may receive stimuli indicating eighth notes, another may receive stimuli indicating a rhythmic pattern and so forth, yet all receive stimuli timed to indicate common measure beginnings.

For embodiments comprising wireless transmission of the generated signals, the transducer unit 29 (or units) of the present invention generally comprises a receiver 31, for receiving the signal transmitted from the transmitter 26 of the base unit 20, and a transducer 35, for producing according to the received signal a stimulation perceivable by the musician using the transducer unit 29. Additionally, each transducer unit 29 may comprise a driver circuit 53 as may be necessary to convert the output from the receiver 31 to a signal appropriate for use by the transducer 35 associated with the transducer unit 26. Likewise, a driver circuit 53 is also provided in association with the base unit 20 for each hardwired channel from the base unit as appropriate for use by the transducer 35 associated with each particular hardwired channel.

Although those of ordinary skill in the art will recognize that any wireless technology, such as, for example, an infrared transmission system, may be utilized for implementation of the present invention, Applicant has found it preferable to utilize a radio frequency transmission system. As will be appreciated by those of ordinary skill in the art, a radio frequency transmission system generally has greater range capability than does an infrared system and is also generally more impervious to varying lighting conditions and the presence of obstructions between the base unit 20 and a remotely located transducer unit 29. Additionally, an appropriate radio frequency transmission system may generally be as readily and economically implemented as any other wireless technology.

Figure 2:
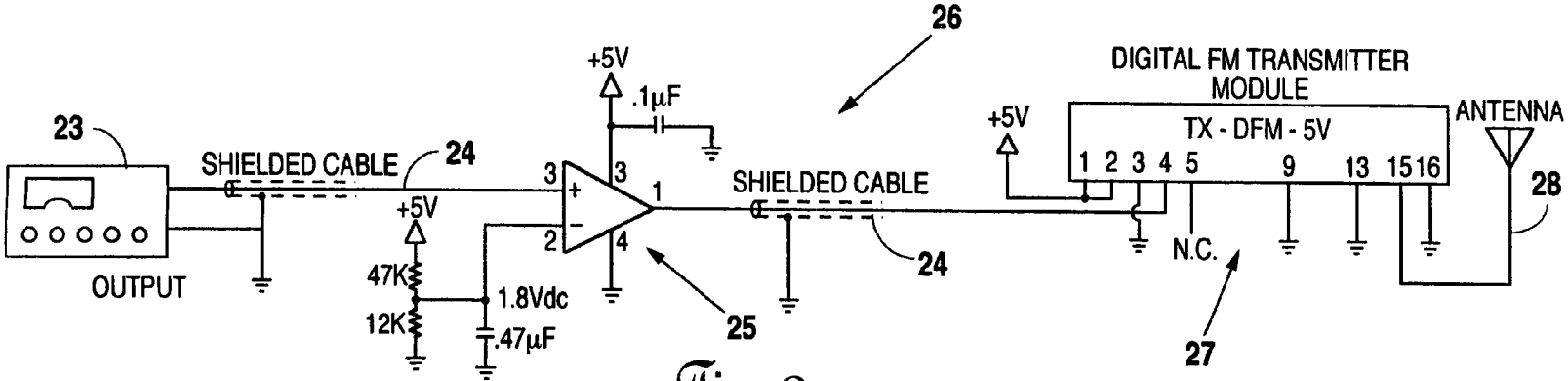
FIG. 2 shows, in a schematic diagram, details of one embodiment of a transmitter circuit, as depicted in FIG. 1, appropriate for implementation of the base unit of the metronome of the present invention.
Figure 4:
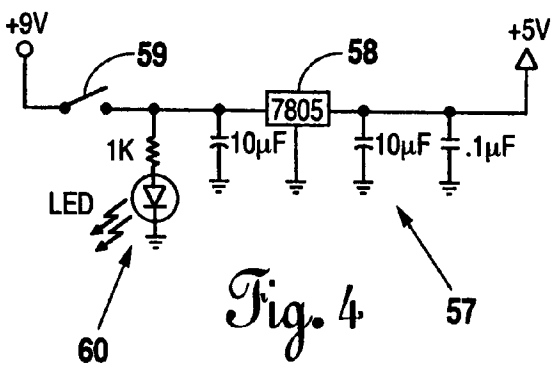
FIG. 4 shows, in a schematic diagram, details of one embodiment of a power conditioning circuit as may be implemented for use with the transmitter circuit of FIG. 2 and/or the receiver circuit of FIG. 3.
Figure 3:
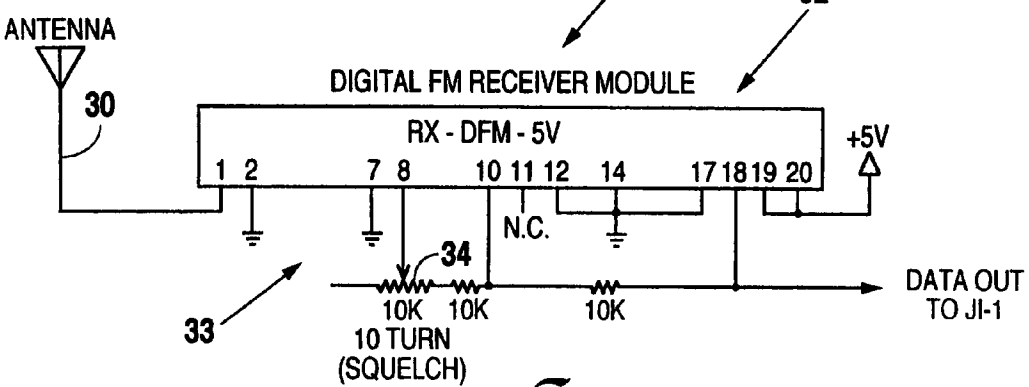
FIG. 3 shows, in a schematic diagram, details of one implementation of a receiver circuit, as depicted in FIG. 1, appropriate for implementation of the remote transducer unit of the metronome of the present invention.
Figure 6:
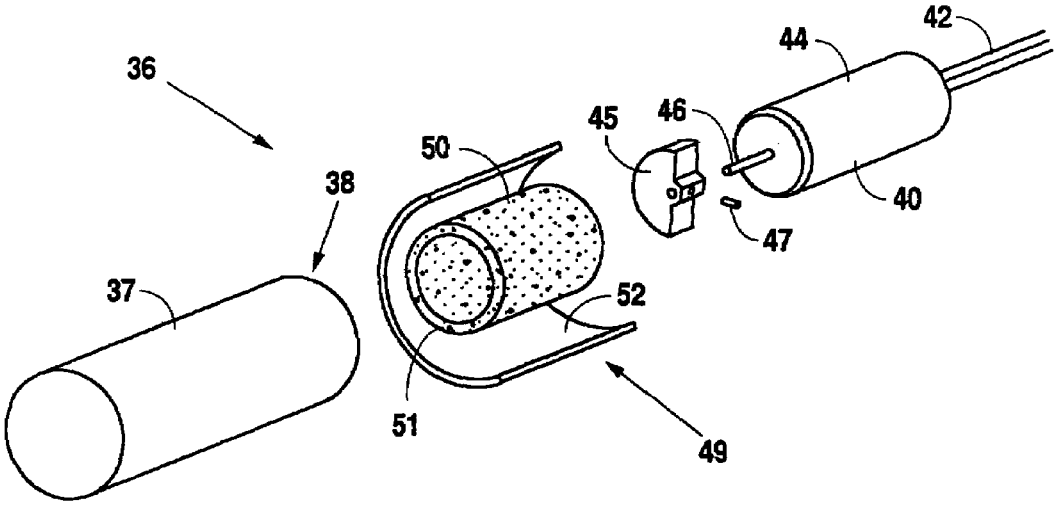
FIG. 6 shows, in an exploded perspective view, the preferred embodiment of a vibrating transducer as has been found to be optimum for use with the transducer unit of FIG. 1.
Figure 7:
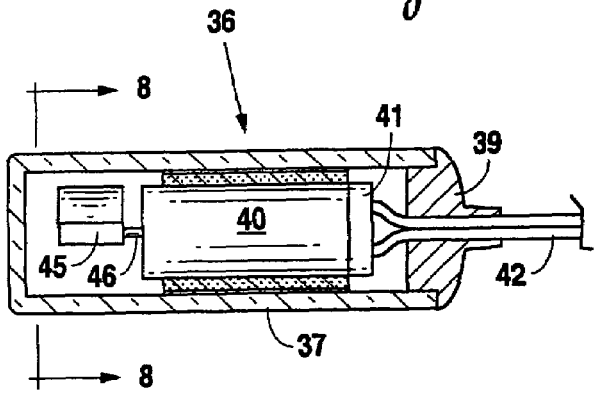
FIG. 7 shows, in a cross sectional side view, details of the arrangement of the internal components of the vibrating transducer of FIG. 6.

Referring now to FIGS. 2 through 4, in particular, an exemplary radio frequency transmission system, as may be utilized in implementation of the present invention, is shown to generally comprise a radio frequency transmitter 26 (depicted in FIG. 2) and a radio frequency receiver 31 (depicted in FIG. 3). As will be understood by those of ordinary skill in the art, each receiver 31 is tuned to receive the signal output from one of the transmitters 26. Additionally, as shown in FIG. 6, the radio frequency transmission system may also comprise power conditioning and regulation circuitry 57 as may be necessary for operation of both the transmitters 26 and the receivers 31.

Referring now to FIG. 2, it is shown that an appropriate transmitter 26 may be implemented utilizing a commercially available, off-the-shelf digital transmitter module 27. One such module 27 is the model TX-DFM-5V digital frequency modulated ("FM") transmitter module available from AUREL S.p.A. of Modigliana, Italy. In implementing the base unit 20 with such a transmitter 26, the signal output from the signal generator 23 is fed, preferably through a shielded cable 24 to prevent interference, into the manufacturer-designated input pin of the integrated transmitter module 27. The integrated transmitter module then modulates the input signal onto a carrier radio frequency, as is well understood to those of ordinary skill in the art. The modulated carrier radio frequency is then fed from the manufacturer-designated output pin of the integrated transmitter module 27 to an antenna 28 for transmission to the remotely located transducer unit 29. Additionally, as shown in FIG. 2, a buffer 25 may be provided in the channel between the signal generator 23 and the transmitter 26 to ensure that the signal output from the signal generator 23 is electrically compatible with the integrated transmitter module 27. (It is noted that for clarity the exemplary digital transmitter module 27 described is a single frequency system; those of ordinary skill in the art will thus recognize that in implementations comprising multiple radio frequency transmission channels a slightly more complex module having multiple frequency selections must be implemented, as is well within the capacity of those of ordinary skill in the art.)

Referring now to FIG. 3, it is shown that an appropriate receiver 31 may be implemented utilizing a commercially available, off-the-shelf digital receiver module 32 compatible with the transmitter module 27. One such module 32 is the model RX-DFM-5V digital FM receiver module also available from AUREL S.p.A. of Modigliana, Italy. In implementing the transducer unit 29 with such a module 32, the signal transmitted from the base unit 20 is received through an antenna 30 into the manufacturer-designated input pin of the integrated receiver module 32. As is well understood by those of ordinary skill in the art, the integrated receiver module 32 demodulates the signal placed on the carrier signal from the carrier signal and outputs the resulting signal, which is essentially the signal output from the signal generator 23 of the base unit 20, through the manufacturer-designated output pin from the integrated receiver module 32. The output signal is then fed to the transducer 35 either directly or, if necessary, through a driver circuit 53, as will be discussed in more detail further herein. In any case, Applicant has also found it desirable to provide a squelch function 33 in association with the integrated receiver module 32 to prevent unintended operation of the transducer 35 such as may occur if the receiver 31 should pick up radio frequency interference or noise through its antenna 30. As will be appreciated by those of ordinary skill in the art, typical integrated receiver modules 32 are available off-the-shelf with this feature, implementation requiring only the provision of a multi-turn potentiometer 34 at the manufacturer-designated pins of the integrated receiver module 32. (Again, as with the transmitter module 27, it is noted that for clarity the exemplary digital receiver module 32 described is a single frequency system; as before, those of ordinary skill in the art will thus recognize that in implementations comprising multiple radio frequency transmission channels a slightly more complex module having multiple frequency selections must be implemented, as is well within the capacity of those of ordinary skill in the art.)

As shown in FIG. 4, and previously discussed, both the transmitter 26 and the receiver 31 may be provided with power conditioning and regulation circuitry 57. As shown in the figure, such circuitry 57 may include an integrated voltage regulator 58 for maintaining a constant voltage for powering of the transmitter 26 and/or receiver 31. Additionally, one or more capacitors to ground may be provided to filter out high frequency noise as may be expected in the implementation of any radio frequency transmission system. Still further, however, such a circuit 57 preferably comprises an ON-OFF switch 59 and may also include a power on indicator 60, which may be readily implemented with a light emitting diode ("LED") connected to the unregulated power bus through a current limiting resistor.

As previously discussed the base unit 20 (for hardwired channels) and the transducer units 29 (for wireless channels) of the metronome 15 of the present invention may each comprise a driver circuit 53 for interfacing with the transducers 35. Importantly, it is noted that implementations utilizing transducers 35 comprising an electric motor will typically require a driver circuit, such as the driver circuit 53 shown in FIG. 5, comprising an output amplifier 54, which enables logical level signals, such as output from the controller 21 or the above-described receivers 31, to drive an electric motor (such as is utilized in the preferred implementation of a vibrating transducer 36 described in detail further herein). As will be appreciated by those of ordinary skill in the art, this requirement stems from the fact that such an electric motor will generally have a current requirement beyond the capabilities of most low power solid state components. Additionally, in such implementations, the driver circuits 53 will also require implementation of a power conditioning circuit 56 having the capability to prevent and/or suppress voltage spiking, such as may be expected in response to the highly inductive load typical of the type of electric motor utilized in the implementation of the vibrating transducer 36.

Figure 5:
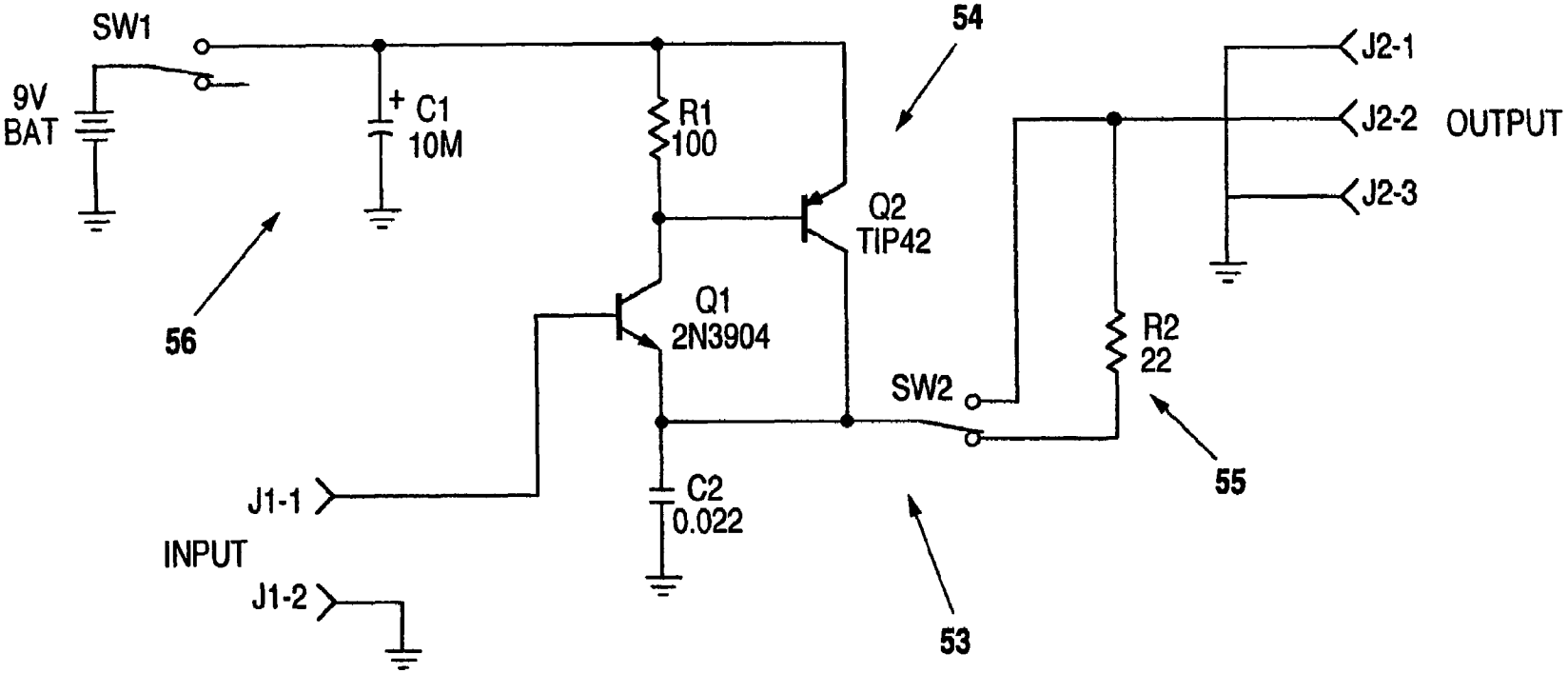
FIG. 5 shows, in a schematic diagram, details of one embodiment of a driver circuit, as depicted in FIG. 1, appropriate for operation of the vibrating transducer of FIG. 6.

As shown in FIG. 5, an exemplary output amplifier 54, as is appropriate for use with the vibrating transducer 36 described further herein, comprises a 2N3904 NPN BJT transistor Q1, configured as an emitter follower, coupled with a TIP42 high current PNP transistor Q2 in a TO-220 heat dissipating package, for providing the necessary current for operation of the electric motor 40 of the vibrating transducer 36. As will be recognized by those of ordinary skill in the art, the output amplifier 54 as shown may be considered a two stage, high current emitter follower. The power conditioning circuit 56, which is preferably provided to prevent and/or suppress voltage spiking, such as may be expected in response to the highly inductive load typical of the type of electric motor 40 utilized in the implementation of the vibrating transducer 36 may be implemented by tying a 10 μF electrolytic capacitor C1 to ground from the 9-V power bus from, for example, a 9-V battery BAT. As will be recognized by those of ordinary skill in the art, the electrolytic capacitor C1 will temporarily supply additional current to the 9-V bus as may be required to compensate for transients resulting from the draw upon the output amplifier 54 caused during startup of the electric motor 40 of the vibrating transducer 36. Additionally, the power conditioning circuit 56 preferably comprises an ON-OFF switch SW1 and may also include a power on indicator, if desired.

In order to adjust the "feel" of the metronome, as implemented with a tactile vibrating transducer 36, the output from the output amplifier 54 is preferably fed through an output power level selector 55 to an output jack J2, into which the power cord plug 43 of the power cord 42 to the electric motor 40 of the vibrating transducer 36 may be operably inserted. As shown in FIG. 5, the output power level selector 55 preferably comprises a 22 Ω resistor R2, which is selectively placed in series with the output circuit by selecting the appropriate position of a single pole, single throw switch SW2. Although Applicant has found that 22 Ω is an appropriate value for the resistor R2, it is noted that the value is selected empirically in order to obtain the user desired tactile feel for the "low" output selection. Additionally, those of ordinary skill in the art will recognize that the resistor R2 may be replaced with a potentiometer, thereby providing a fully adjustable output power level.

Although the driver circuit 53 has been described as being integral with either the base unit 20 or, if appropriate, the transducer units 29, it should be appreciated that the present invention contemplates that any necessary driver circuit may be provided as part of the transducers 35. In this manner, the base unit 20 or transducer units 29 may be utilized with virtually any type of transducer 35, the driver circuits being adapted to provide all necessary electrical compatibility between the chosen transducer 35 and the output of the controller 21 or the receivers 31. In such implementations, the driver circuits should be provided with an input jack J1 for receiving signals from the base unit 20 or receivers 31.

Referring now to the FIGS. 6 through 10 in particular, a preferred embodiment of a tactile transducer, as preferred for use in implementing the metronome of the present invention, is shown to comprise a vibrating transducer 36 having the unique ability to produce multiple easily differentiated tactile stimulations. As shown in the figures, such a vibrating transducer 36 generally comprises an electric motor 40 having attached thereto an eccentric weight 45 and encased within a rigid housing 37. As is typical with pager transducers and the like, operation of the electric motor 40 turns a shaft 46 upon which the eccentric weight 45 is mounted with, for example, a pin 47. As will be appreciated by those of ordinary skill in the art, rotation upon the shaft 46 of the eccentric weight 45 produces a vibratory effect upon the motor 40 resulting from the forward portion 44 of the motor 40 attempting to shift laterally outward from the nominal axis of rotation 48 of the shaft 46, as depicted by the centrifugal force lines F in FIG. 9.

In typical implementations of this principle, the electric motor is rigidly fixed to some body such as, for example, a pager or cellular telephone housing with mounting clamps, brackets or the like. In the present implementation, however, unlike the vibrating transducers of the prior art, the electric motor 40 is encased within a rigid housing 37 by the provision of a flexible motor mount 49, which allows the forward portion 44 of the electric motor 40 to generally wobble within the rigid housing 37 as the eccentric weight 45 is rotated upon the motor shaft 46. In this manner, the resultant forces F are the product of much greater momentum in the eccentric weight 45 than that obtained in the fixed configuration of the prior art.

In the preferred implementation, as particularly detailed in FIGS. 6 through 9, the flexible motor mount 49 generally comprises a wrapping of preferably foam cushion material 50, which is sized and shaped to snuggly fill the space provided between the electric motor 40 and the interior of the rigid housing 37. To facilitate manufacture of the vibrating transducer 36, as generally depicted in FIG. 6, the foam cushion 50 may be held in place about the body of the electric motor 40 with a cushion securing sheet 52, which may comprise a thin paper glued in place about the cushion 50, thin adhesive tape or any substantially equivalent means. To complete the manufacture of the vibrating transducer 36, the cushioned electric motor 40, with eccentric weight 45 attached to its shaft 46, is inserted into the rigid housing 37 and secured in place by the application of epoxy 39 into the open, rear portion 38 of the housing 37. As will be understood by those of ordinary skill in the art, the epoxy 39 also serves to stabilize the power cord 42 to the rear portion 41 of the electric motor 40, thereby preventing accidental disengagement of the power cord 42 from the electric motor 40.

Figure 8:
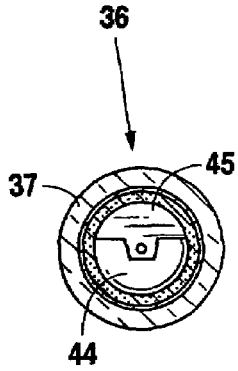
FIG. 8 shows, in a cross sectional end view taken through cut line 8-8 of FIG. 9, additional details of the arrangement of the internal components of the vibrating transducer of FIG. 6.
Figure 9:
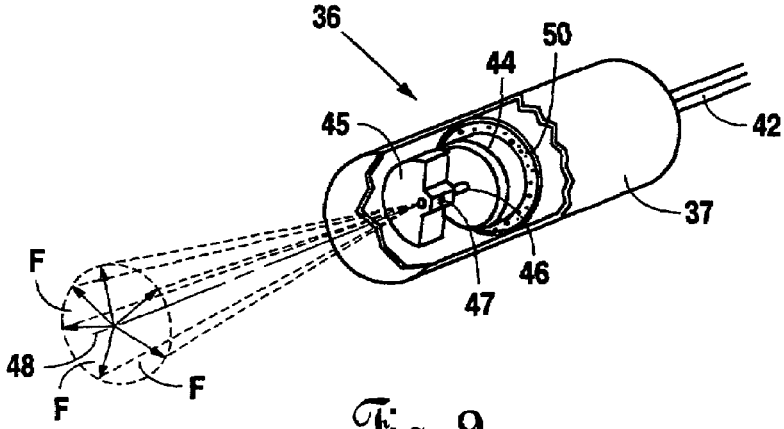
FIG. 9 shows, in a partially cut away perspective view, a representation of the forces produced in the operation of the vibrating transducer of FIG. 7.
Figure 10A:
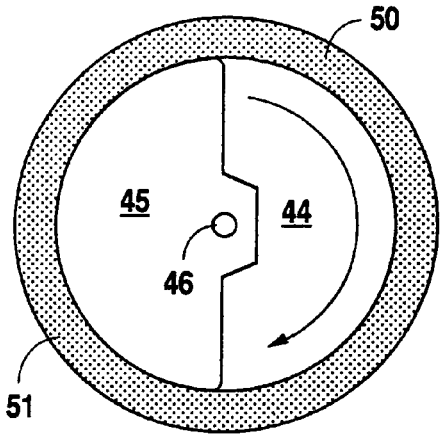
FIGS. 10A through 10F show, in schematic representations generally corresponding to the view of FIG. 8, changes in the relative positions of various internal components of the vibrating transducer of FIG. 6, which changes occur as a result of the operational forces represented in FIG. 9.
Figure 10B:
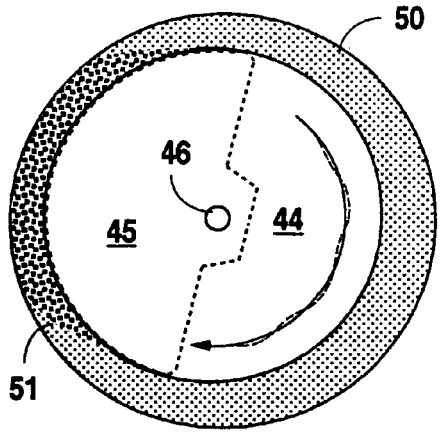
Figure 10C:
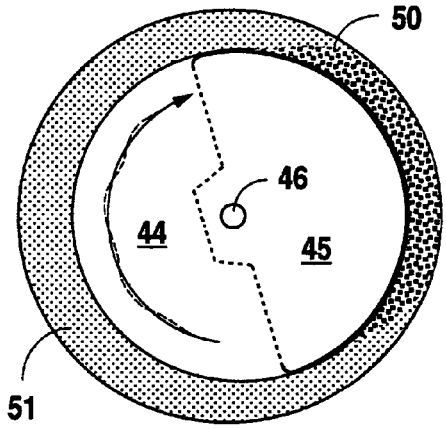
Figure 10D:
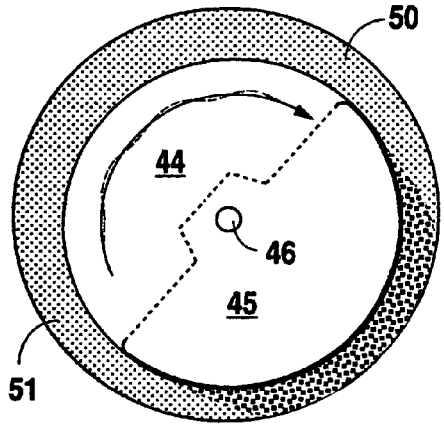
Figure 10E:
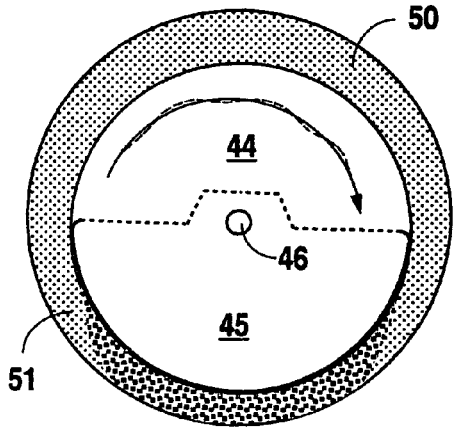
Figure 10F:
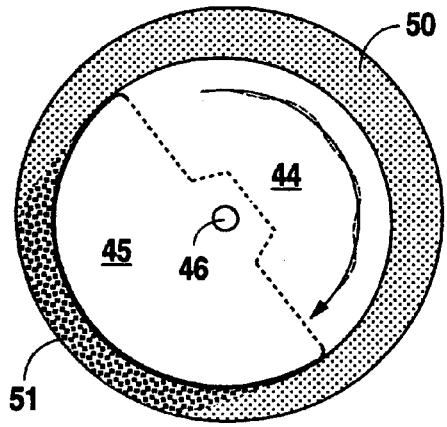

Referring now to FIGS. 8 through 10 in particular, the enhanced operation of the vibrating transducer 36 is detailed. At the outset, however, it is noted that in order to obtain maximum vibratory effect, the rigid housing 37 is provided in a generally cylindrical shape, as will be better understood further herein. In any case, as shown in the cross sectional view of FIG. 8, and corresponding views of FIGS. 10A through 10F, the forward portion 44 of the electric motor 40 is encompassed by the forward portion 51 of the foam cushion 50. At rest, i.e. without the electric motor 40 in operation, the electric motor 40 is substantially uniformly surrounded by the foam cushion 50, as shown in FIG. 10A.

Upon actuation of the electric motor 40, however, the centrifugal forces F generated by the outward throw of the eccentric weight 45 causes the axis of rotation 48 of the motor's shaft 46 to follow a conical pattern, as depicted in FIG. 9. As a result, the forward portion 44 of the electric motor 40 is thrown into the forward portion 51 of the foam cushion 50, depressing the area of cushion 50 adjacent the eccentric weight 45 and allowing expansion of the portion of the cushion 50 generally opposite, as depicted in FIGS. 10B through 10F corresponding to various rotational positions of the eccentric weight 45.

As is evident through reference to FIGS. 10B through 10F, the cooperative arrangement of the cushion 50 about the electric motor 40, as also enhanced by the cylindrical shape of the rigid housing 37, allows the eccentric weight 45 to build greater momentum than possible in embodiments where the motor is rigidly affixed to a body. As the forward portion 51 of the foam cushion 50 compresses under the centrifugal forces F of the eccentric weight 45, however, a point is reached where the foam cushion 50 is no longer compressible against the interior wall of the rigid housing 37 and the forward portion 44 of the electric motor 40 is repelled away from the interior wall toward the opposite portion of interior wall.

The result is a vibratory effect much more pronounced than that obtained in prior art configurations calling for the rigid affixation of an electric motor to a housing. Additionally, Applicant has found that the resulting pronounced vibratory effect is generally more perceptible to the human sense of touch than is that produced by prior art configurations. In particular, small differences on the order of tens of milliseconds or less in duration of operation of the vibrating transducer 36, i.e. duration of powering of the electric motor 40, are easily perceived and differentiated. As a result, this implementation of the vibrating transducer 36 is particularly adapted for implementation of the metronome of the present invention, which preferably comprises provision for distinct tactile stimuli representing downbeats versus divisional beats as well as the generation and communication of complex rhythms, which may require very quickly perceived stimulations with very little pause therebetween.

For use of the metronome of the present invention, each musician affixes his or her transducer 35 in a minimally obtrusive location utilizing a strap or the like. The musician then connects the electrical cable 42 between the transducer 35 and the base unit 20 or a receiver 31 by inserting the standard plug 43 into the output jack from one channel of the base unit 20 or from a transducer unit 29 tuned to a wireless channel from the base unit 20. The output power level selector 55, which is preferably provided as previously described, is then utilized to adjust the "feel" of the metronome of the present invention.

With the transducers 35 positioned as desired for each musician making use of the metronome of the present invention, a conductor, bandleader, music instructor, lead musician or the like utilizes the provided control input 22 and display to set, on a per channel basis, the beats per minute and, if desired, rhythmic pattern, to be generated by the signal generator 23. To this end, those of ordinary skill in the art will recognized that the display should be adapted to provide a digital readout of the current setting. Additionally, however, it is contemplated by the present invention that the display may also be adapted to provide a graphical readout comprising a musical score, such as those shown in FIG. 11, especially when the controller 21 is programmed to produce more complicated rhythms such as that depicted in the upper scores of FIG. 11. In any case, with the transducers 35 in proper position and the base unit 20 set up as desired, the transmitters 26 and receivers 31 or receivers, if utilized, are powered on and the musicians may perform their musical instruments of choice with the metronome under the centralized control of the conductor, bandleader, music instructor, lead musician or the like.

As will be appreciated by those of ordinary skill in the art, especially in light of this exemplary description, the controller 21 may be readily provided with a timing circuit or programmed to provide complex beat patterns. In such an embodiment, a communication interface or other programming input as well as read only or non-volatile random access memory are preferably provided for the base unit 20 such that the conductor, bandleader, music instructor, lead musician or the like may input and/or select a desired beat pattern. In one such embodiment, as will be discussed in further detail herein, an electronic score may be programmed into the controller 21, either directly or through a computer or PDA interface, whereafter the conductor, bandleader, music instructor, lead musician or the like need only select desired tempo and starting point to have the metronome of the present invention produce, for each musician provided with a transducer 35, rhythmic stimulation for literally a complete musical selection.

Figure 11:
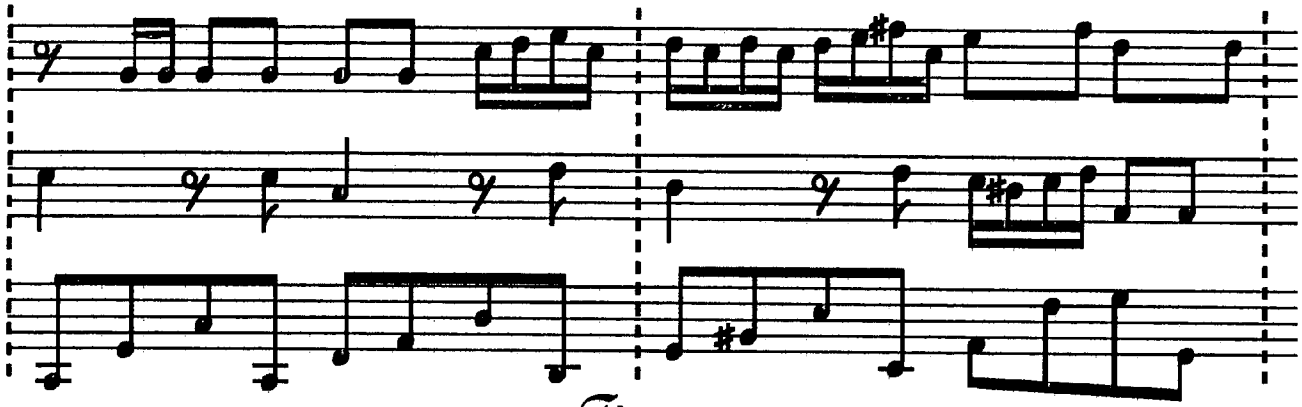
FIG. 11 shows, in a multiple part musical score, a typical orchestral arrangement with which the multiple channel metronome of FIG. 1 may be utilized.

In any case, as previously discussed, the metronome of the present invention is preferably adapted to impart to a musician, or plurality of musicians, tactile stimulations indicative of tempo and measure timing, as shown in the lower score of FIG. 11, as well as of tempo, measure timing and complex rhythmic patterns, as shown in the upper scores of FIG. 11. In particular, the preferred embodiment of the present invention contemplates imparting tempo information by the timing of the beginning of signal outputs from the signal generator 23 of the base unit 20. In order to differentiate downbeats, indicative of measure timing, the signal generator 23 is adapted under the control of the controller 21 of the base unit 20 to produce a signal output of longer duration than those indicative of divisional beats, the former of which will be noticeably perceived by the musician or plurality of musicians as being of much greater intensity than the latter, especially when imparted through the foregoing described vibrating transducer 36. As shown in the lower timing plot of FIG. 12, the controller 21 is programmed to implement these aspects of the present invention by simply effecting at a set tempo a repeating pattern of output pulses from the signal generator 23 representing the downbeats and divisional beats.

Figure 12:
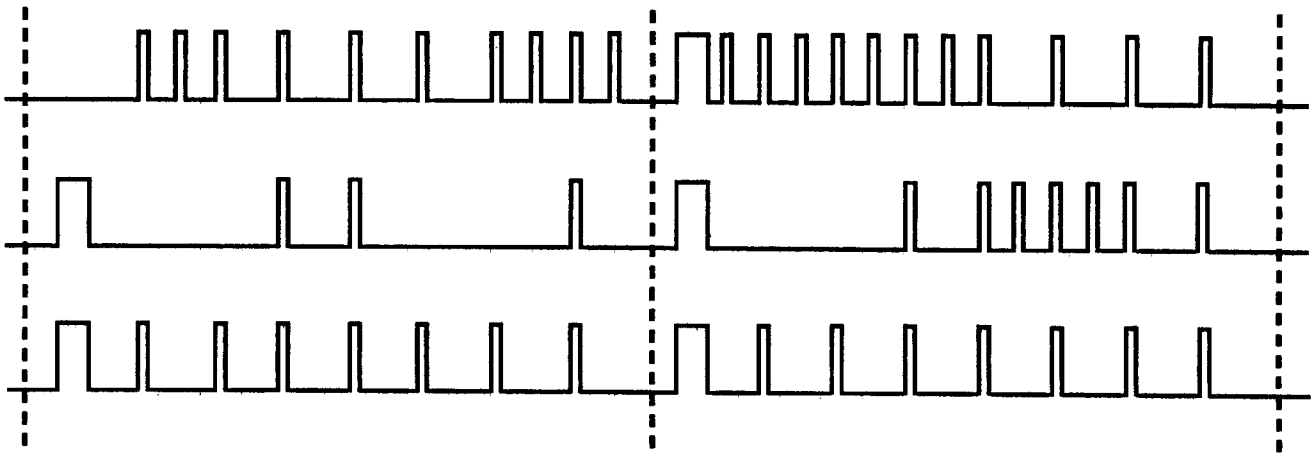
FIG. 12 shows, in a series of voltage waveforms aligned with a musical score of FIG. 11, representative signals as may be generated by the signal generator of FIG. 1 for operation through the driver circuit of FIG. 4 of the vibrating transducer of FIG. 5, the waveforms having characteristics such that the tempo and timing of measures, as well as rhythms, of the score of FIG. 11 may be readily perceived by the individual musicians employing the metronome of the present invention to play their respective parts.

As shown in the upper scores of FIG. 11 and corresponding upper timing plots of FIG. 12, however, the metronome of the present invention is also preferably adapted to impart to a musician, or plurality of musicians, tactile stimulations indicative of not only tempo and measure timing, but also complex rhythmic patterns. In this case, the controller 21 of the base unit 20 is preferably programmed to "follow" the score of a musical selection chosen by the conductor, bandleader, music instructor, lead musician or the like. In the alternative, however, the controller 21 may be pre-programmed with a plurality of rhythmic patterns, which may be simply selected through user input to the controller 21. As will be appreciated by those of ordinary skill in the art, the latter will have great utility in mastering basic rhythms. In any case, the preferred embodiment of the present invention contemplates that an appropriate programming interface be provided to allow the conductor, bandleader, music instructor, lead musician or the like to input to the controller 21 any desired rhythmic pattern or, for that matter, an entire musical score. As shown in the upper time plots of FIG. 12, the controller 21 controls the signal generator 23 of the base unit 20 to produce output pulses only when the score calls for a note to be performed, giving greater duration, or intensity, to those pulses corresponding to downbeats.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. For example, those of ordinary skill in the art will recognize that with sacrifice of the benefits described herein with respect to the preferred embodiment of the tactile vibrating transducer 36, the transducers 35 of the multiple channel metronome 15 of the present invention may be implemented as a piezoelectric device, buzzer, pair of electrodes, a bone density resonator, an electrical stimulation device, a mechanical transducer, an eccentric motion generator, an audible device or any other substantially equivalent structure capable of imparting the desired tactile stimulation. In any case, because the scope of the present invention is much broader than any particular embodiment, the foregoing detailed description should not be construed as a limitation of the scope of the present invention, which is limited only by the claims appended hereto.

What is claimed is:

1. A multiple channel metronome for use under the control of a leader by a plurality of musicians, the multiple channel metronome comprising:

a user interface for selecting beat patterns or tempos;

a signal generator having a plurality of independent communication channels, the signal generator being adapted to simultaneously produce signals representing a plurality of different beat patterns or tempos, the signal generator being further adapted to output each beat pattern or tempo onto its own corresponding independent communication channel;

a plurality of transducers in communication with the signal generator, each transducer being adapted to impart a tactile sensation to a musician; and wherein the selected one of said beat patterns is selected by said leader via said user interface to place the transducer in communication with the corresponding communication channel.

2. The multiple channel metronome as recited in claim 1, wherein:

the signal generator produces a signal representing a complex beat pattern including an indicator of downbeats and an indicator of divisional beats, said indicators being distinct one from the other;

the transducers impart tactile stimulations indicative of downbeats that are distinct from tactile stimulations indicative of divisional beats; and each said timing scheme comprises a user selectable tempo.

3. The multiple channel metronome as recited in claim 1, wherein said beat patterns or tempos are user selectable.

4. The multiple channel metronome as recited in claim 1, wherein said beat patterns or tempos are user definable.

5. The multiple channel metronome as recited in claim 4, said multiple channel metronome further comprising a programming interface to said controller, said programming interface enabling the user to input a rhythmic pattern to said controller.

6. The multiple channel metronome as recited in claim 5, wherein said rhythmic pattern comprises a musical score.

7. The multiple channel metronome as recited in claim 1, wherein each said transducer comprises:

a rigid housing;

an electric motor enclosed within said rigid housing, said electric motor having attached thereto an eccentric weight; and wherein said electric motor is supported within said rigid housing by a motor mount that enables the electric motor, when energized, to wobble within the second portable housing so that the eccentric weight orbits about an elliptical path.

8. The multiple channel metronome as recited in claim 7, wherein said rigid housing comprises a generally cylindrically shaped tube.

9. The multiple channel metronome as recited in claim 1, further comprising a computer to provide the beat patterns or tempos to the signal generator.

10. The multiple channel metronome as recited in claim 9, wherein said computer comprises a personal computer.

11. The multiple channel metronome as recited in claim 9, wherein said computer comprises a PDA.

12. The multiple channel metronome of claim 1, wherein at least one of said plurality of independent communication channels is a wireless channel.

13. The multiple channel metronome of claim 1, wherein each of said plurality of independent communication channels is a wireless channel.

14. The multiple channel metronome of claim 1, further comprising, for each transducer, a strap securing said transducer in place on the musician's body.

15. A metronome apparatus for coordinating a plurality of musicians, the apparatus comprising:

a user interface for selecting beat patterns or tempos;

a signal generator adapted to simultaneously generate a plurality of selectable signals representative of beat patterns or tempos and transmit the plurality of selectable signals simultaneously;

a plurality of transducers in communication with the signal generator, each transducer being adapted to impart tactile sensations corresponding to a selected one of said selectable signals to a musician wearing the transducer.

16. The metronome apparatus of claim 15, wherein:

the signal generator produces a complex beat pattern including an indicator of downbeats and an indicator of divisional beats, said indicators being distinct one from the other; and the signal generator produces a signal representing a complex beat pattern including an indicator of downbeats and an indicator of divisional beats, said indicators being distinct one from the other;

the transducers impart tactile stimulations indicative of downbeats that are distinct from tactile stimulations indicative of divisional beats; and each said timing scheme comprises a user selectable tempo.

17. The metronome apparatus of claim 15, wherein each said transducer comprises:

a rigid housing;

an electric motor enclosed within said rigid housing, said electric motor having attached thereto an eccentric weight; and wherein said electric motor is supported within said rigid housing by a motor mount that enables the electric motor, when energized, to wobble within the second portable housing so that the eccentric weight orbits about an elliptical path.

18. The metronome apparatus as recited in claim 17, wherein said rigid housing comprises a generally cylindrically shaped tube.

19. The metronome apparatus of claim 15, further comprising:

a wireless receiving unit associated with each transducer;

a short range wireless transmitter associated with the signal generator for wirelessly transmitting the signals generated by the signal generator to the wireless receiving units.

20. The metronome apparatus of claim 19, wherein:

the signal generator produces a complex beat pattern including an indicator of downbeats and an indicator of divisional beats, said indicators being distinct one from the other; and the signal generator produces a signal representing a complex beat pattern including an indicator of downbeats and an indicator of divisional beats, said indicators being distinct one from the other;

the transducers impart tactile stimulations indicative of downbeats that are distinct from tactile stimulations indicative of divisional beats; and each said timing scheme comprises a user selectable tempo.

21. The metronome apparatus of claim 19, wherein each said transducer comprises:

a rigid housing;

an electric motor enclosed within said rigid housing, said electric motor having attached thereto an eccentric weight; and wherein said electric motor is supported within said rigid housing by a motor mount that enables the electric motor, when energized, to wobble within the second portable housing so that the eccentric weight orbits about an elliptical path.

22. The metronome apparatus of claim 21, wherein said rigid housing comprises a generally cylindrically shaped tube.

23. The metronome apparatus of claim 19, wherein said transmitter transmits an infrared signal.

24. The metronome apparatus of claim 19, wherein said transmitter transmits a radio frequency signal.

25. The metronome apparatus of claim 24, wherein said radio frequency signal is frequency modulated.

26. The metronome apparatus of claim 19, further comprising a computer to provide the beat patterns or tempos to the signal generator.

27. The metronome apparatus of claim 26, wherein said computer comprises a personal computer.

28. The metronome apparatus of claim 26, wherein said computer comprises a PDA.

* * * * *